US006817354B2

(12) United States Patent
Laitinen

(10) Patent No.: US 6,817,354 B2
(45) Date of Patent: Nov. 16, 2004

(54) WOOD BURNING FURNACE

(75) Inventor: Elmer Laitinen, Wheeler, MI (US)

(73) Assignees: Patricia A. Laitinen, Wheeler, MI (US); Bruce Laitinen, Lunenburg, MA (US); Joe Gombar, Fenton, MI (US)

( * ) Notice: Subject to any disclaimer, the term of this patent is extended or adjusted under 35 U.S.C. 154(b) by 0 days.

(21) Appl. No.: 10/261,253

(22) Filed: Sep. 30, 2002

(65) Prior Publication Data

US 2004/0060553 A1 Apr. 1, 2004

(51) Int. Cl.[7] ..... F24C 1/14
(52) U.S. Cl. ..... 126/77; 126/112; 126/61
(58) Field of Search ..... 126/77, 61, 66, 126/83, 500, 76, 110 R, 110 A, 163 R, 112, 117, 99 R; 110/315, 316

(56) References Cited

U.S. PATENT DOCUMENTS 1,135,478 A * 4/1915 Wood ..... 126/61
1,714,649 A * 5/1929 Walouke ..... 126/112
3,236,508 A * 2/1966 Reintjes ..... 126/110 R
4,309,976 A * 1/1982 Starr ..... 126/61
4,343,288 A * 8/1982 Tjosvold ..... 126/77
4,360,000 A * 11/1982 Down ..... 126/77
4,383,517 A * 5/1983 Gillis et al. ..... 126/61
4,621,610 A * 11/1986 Tomooka ..... 126/61
4,672,946 A 6/1987 Craver
5,113,843 A * 5/1992 Henry et al. ..... 126/77
5,357,941 A * 10/1994 Hans Duerichen et al. ... 126/77
5,462,043 A 10/1995 Rose et al.

FOREIGN PATENT DOCUMENTS

JP 2-71011 A * 3/1990

* cited by examiner

*Primary Examiner*—Josiah Cocks
(74) *Attorney, Agent, or Firm*—Timothy S. Stevens; McKellar Stevens, PLLC

(57) ABSTRACT

A wood burning furnace having an enclosed combustion chamber including a top, a bottom, a back, a front and opposing side walls and a secondary combustion air admission chamber including a top, a bottom, a back, a front and opposing side walls, the bottom wall of the secondary combustion air admission chamber being arched and perforated, the bottom wall of the secondary combustion air admission chamber forming at least a portion the top wall of the combustion chamber

6 Claims, 2 Drawing Sheets

WOOD BURNING FURNACE

BACKGROUND

The instant invention relates generally to a furnace for heating air or water for heating, for example, a building, the furnace primarily intended for the burning of wood. More specifically, the instant invention incorporates an improved secondary combustion system into such a furnace.

A simple wood burning stove or furnace usually comprises a metal box having a door for loading wood, an air inlet control system (often part of the door) for controlling the amount of combustion air admitted into the box and an exhaust flue for directing exhaust gases from the box. Such simple wood burning stoves tend to be inefficient because unburned vapors and particulates pass out the exhaust flue. Admitting more combustion air may reduce the amount of unburned vapors and particulates passed out the exhaust flue but then the fire tends to burn too hot and too fast.

A solution to such problems is to promote "secondary combustion". Primary combustion is throttled by controlling the amount of combustion air. The unburned vapors and particulates are then mixed with heated air to burn such vapors and particulates and thereby recover more heat and reduce pollution. U.S. Pat. No. 4,672,946 (herein fully incorporated by reference), for example, described the use of a perforated tube to admit secondary combustion air with the unburned vapors and particulates and then promoted secondary combustion with an insulated combustion device. As a further example, U.S. Pat. No. 5,462,043 (herein fully incorporated by reference) also used a perforated tube system to admit secondary combustion air. However, the prior art secondary combustion systems tend to be too expensive to manufacture or require too much maintenance or require a relatively narrow range of operating conditions.

SUMMARY OF THE INVENTION

The instant invention provides a relatively inexpensive, rugged and maintenance free system for secondary combustion in a wood burning furnace that is effective over a broad range of operating conditions. More specifically, the instant invention is a wood burning furnace, comprising: (a) an enclosed combustion chamber including a top, a bottom, a back, a front and opposing side walls; and (b) a secondary combustion air admission chamber including a top, a bottom, a back, a front and opposing side walls, the bottom wall of the secondary combustion air admission chamber being arched and perforated, the bottom wall of the secondary combustion air admission chamber comprising the top wall of the combustion chamber. A combustion air blower is preferably in fluid communication with the secondary combustion air admission chamber so that combustion air entering the secondary combustion air admission chamber passes through the perforations in the arched bottom wall of the secondary combustion air admission chamber and into the combustion chamber. In addition, an air distribution manifold is preferably disposed within the combustion chamber, the air distribution manifold having openings disposed to direct air passing therethrough toward the bottom of the combustion chamber, the air distribution manifold being in fluid communication with the combustion air blower.

DETAILED DESCRIPTION OF THE INVENTION

Figure 1:
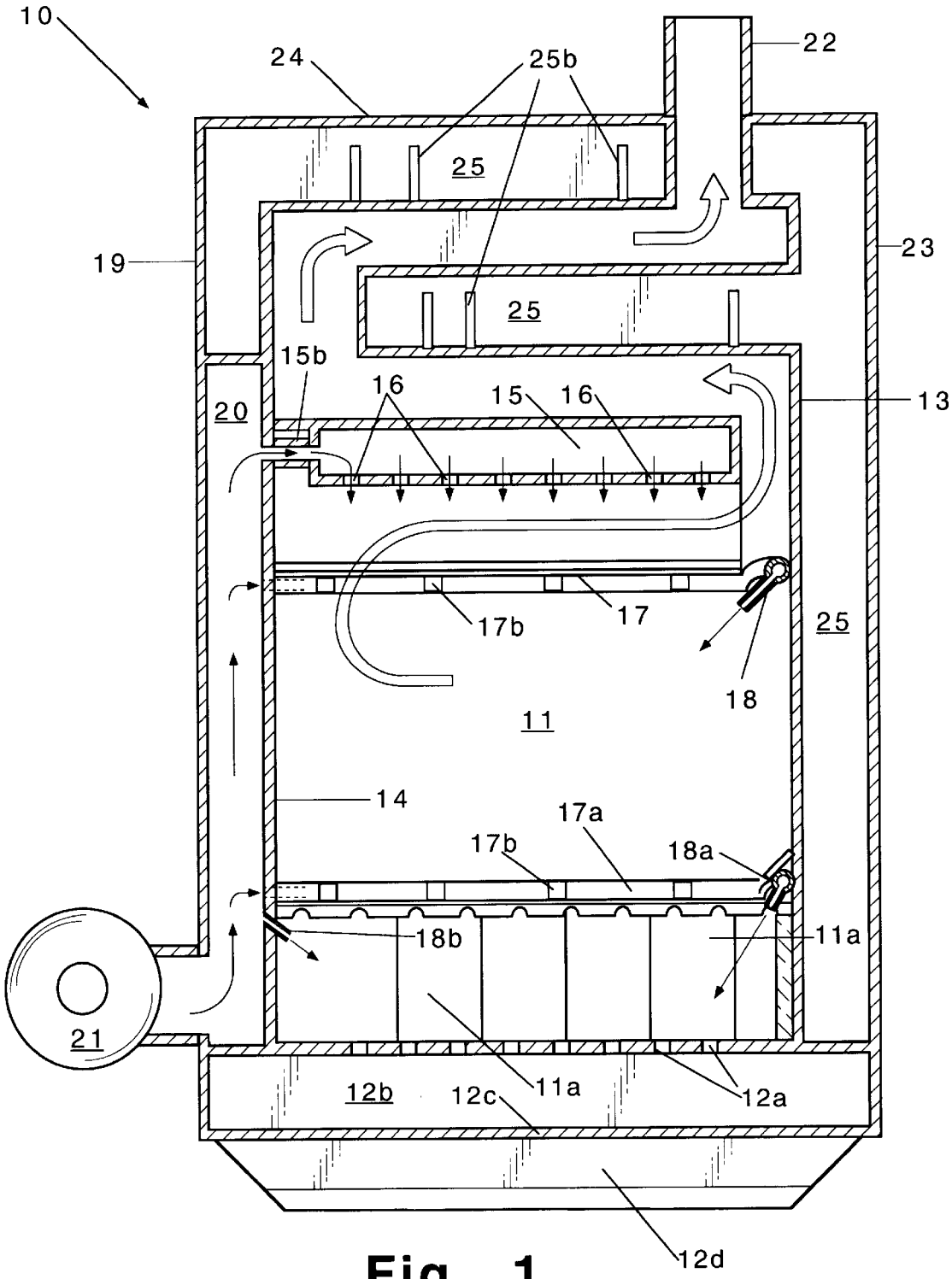
FIG. 1 is a schematic cross-sectioned side view of a furnace according to the instant invention showing a combustion air blower in fluid communication with a secondary combustion air admission chamber having a perforated bottom portion.

Referring now to FIG. 1, therein is shown a schematic cross-sectioned side view of a furnace 10 according to the instant invention. The furnace 10 has an enclosed combustion chamber 11 having a bottom 12, a back 13 and a front 14. A secondary combustion air admission chamber 15 having a top, a bottom, a back, a front and opposing side walls is positioned in the combustion chamber 11. The bottom wall of the chamber 15 is perforated by perforations 16. The bottom wall of the chamber 15 defines a portion of the top of the combustion chamber 11. An air distribution manifold 17 is positioned in the combustion chamber 11. The manifold 17 has openings 18 disposed to direct air passing therethrough toward the bottom of the combustion chamber 11. An air distribution manifold 17*a* is positioned in the combustion chamber 11. The manifold 17*a* has openings 18*a* disposed to direct air passing therethrough toward the bottom of the combustion chamber 11. The furnace 10 has a front panel 19 spaced apart from the front wall 14 to enclose a combustion air pre-heat chamber 20. Five openings 18*b* are disposed to direct air passing therethrough toward the bottom of the combustion chamber 11. A 160 cubic feet per minute capacity combustion air blower 21 blows combustion air into the chamber 20 and then into the manifold 17, the manifold 17*a* and the chamber 15 by way of a 1¼ inch black iron pipe 15*b*. Most preferably, the blower 21 is mounted at the rear of the furnace 10 and the combustion air ducted along the bottom of the furnace to further pre-heat the combustion air and a solenoid valve is installed in this duct to ensure a stoppage of combustion air when the blower 21 is shut off. The combustion air then flows out of the openings 18, 18*a*, 18*b* and the perforations 16. The bottom 12 of the combustion chamber 11 comprises a grate 12*a*. The furnace 10 has a floor 12*c* and an ash pit 12*b*. A skid 12*d* is mounted to the floor 12*c*. The combustion chamber 11 is lined with firebrick 11*a*.

When wood or other solid fuel is placed in the combustion chamber 11 and ignited, the combustion air flowing out of the openings 18*a* and 18*b*, as indicated by the small arrows therefrom, sustains the combustion at the surfaces of the burning wood. The air flowing out of the openings 18 provides additional combustion air directing the hot gas from the burning wood, as indicated by the broad arrows, toward the front wall 14 of the combustion chamber 11, along the perforated surface of the chamber 15 toward the rear wall 13, along the top of the chamber 15 and eventually out the exhaust flue 22 of the furnace 10. The air flowing out of the openings 18 also helps prevent unburned vapors and particulates from exiting the combustion chamber without first being swept toward the front of the combustion chamber and then along the bottom of the chamber 15. The combustion air flowing out of the openings 18 18*a* and 18*b* is pre-heated in the chamber 20 and in the manifolds 17 and 17*a* thereby promoting combustion. The secondary combustion air flowing through the perforations 16, as indicated by the small arrows therefrom, is preheated in the chamber 20 and in the chamber 15 thereby promoting the secondary combustion of the unburned vapors and particulates in the hot gas from the burning wood. The furnace 10 has a rear panel 23 and a top panel 24 enclosing a heat recovery chamber 25 around the combustion chamber 11.

With regard to combustion, the heated air flowing from the openings 18 promotes combustion directed first toward the front of the combustion chamber and then looping back under the chamber 15 where combustion air from the openings 16 and the high temperature of this environment promotes further combustion. The combustion process can continue in the space above the chamber 15. Thus, a primary benefit of the instant invention is the optimization of the "three T's" of efficient combustion: time, turbulence and temperature. The efficiency and pollution control characteristics of a furnace of the instant invention rival those of a furnace equipped with a catalytic converter.

Figure 2:
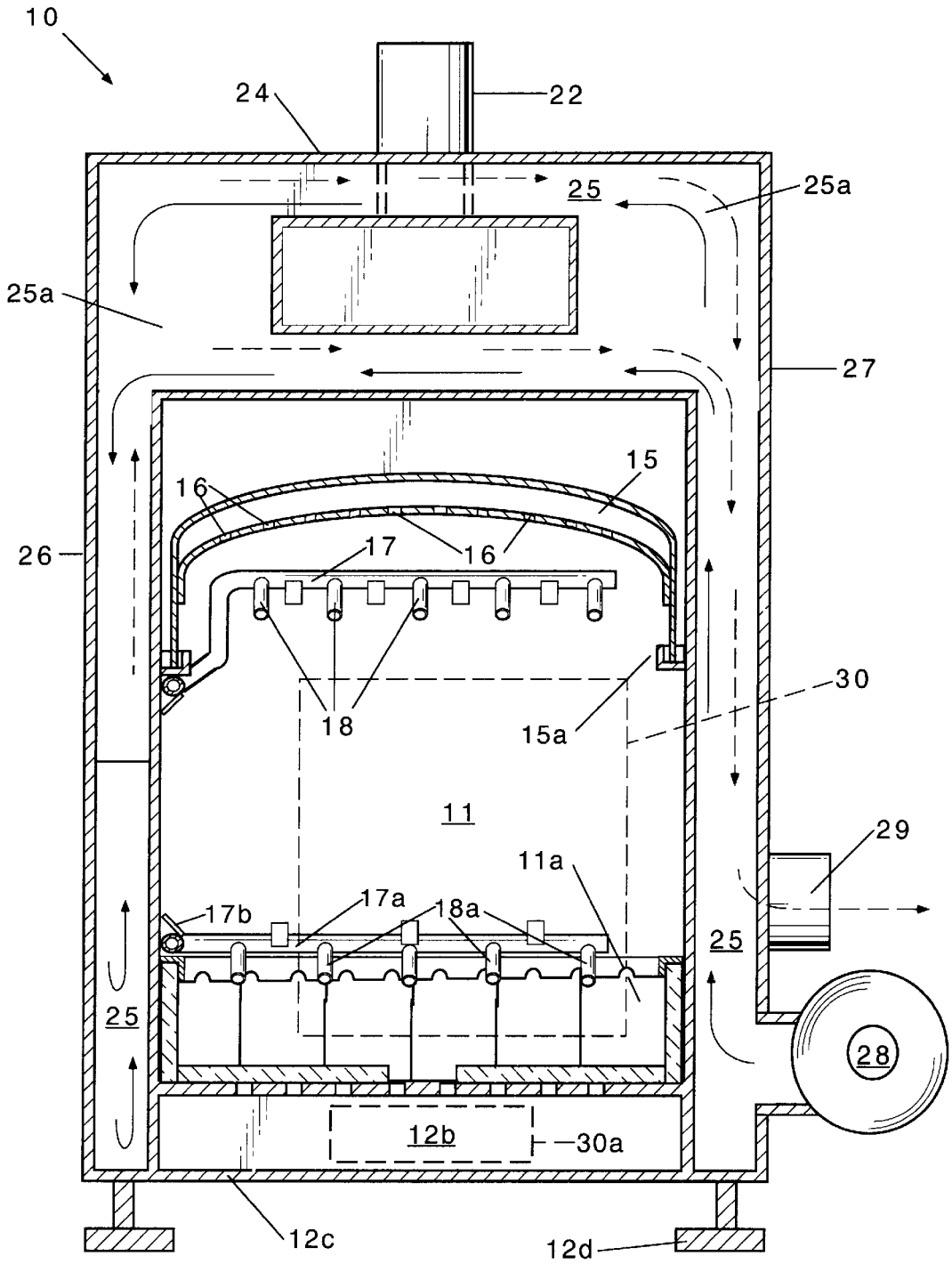
FIG. 2 is a schematic cross-sectioned front view of a furnace according to the instant invention showing the arched bottom portion of the secondary combustion air admission chamber.

Referring now to FIG. 2, therein is shown a schematic cross-sectioned front view of the furnace 10 of FIG. 1. A wood-loading door 30 is positioned at the front of the furnace 10 for loading wood into the combustion chamber 11. The door 30 is insulated with high temperature ceramic insulation. An ash pit door 30*a* is positioned at the front of the furnace 10 for removing ashes from the ash pit 12*b*. The furnace 10 has a left side panel 26 and a right side panel 27 enclosing the heat recovery chamber 25 around the combustion chamber 11. The furnace 10 has a baffle 25*a*. A 2,400 cubic feet per minute capacity heat recovery blower 28 blows air, as indicated by the solid arrows, to be heated into the chamber 25, up and across the front end of the combustion chamber, then down the front end of the combustion chamber, around the bottom edge of the baffle 25*a* to the back of the combustion chamber, then up, over and down the back end and rear of the combustion chamber and finally out the heated air outlet 29 as indicated by the dashed arrows.

The front, back, sides, bottom and top of the furnace 10 are preferably insulated with thermal insulation. The front of the furnace 10 is preferably insulated with one inch of high temperature ceramic insulation and two inches of dense heat resistant fiberglass insulation. The top of the furnace 10 is preferably insulated with four inches of the fiberglass insulation. The sides and back of the furnace 10 are preferably insulated with three inches of the fiberglass insulation. The bottom of the furnace 10 is preferably insulated with two inches of the fiberglass insulation.

Referring now to FIG. 2, it will be noted that the bottom wall of the secondary combustion air admission chamber 15 is arched. This arch shape is important. A substantial amount of heat can be generated by the secondary combustion adjacent the bottom wall of the chamber 15 and high temperature tends to promote more complete combustion. The arched shape of the bottom wall of the chamber 15 allows the bottom wall of the chamber 15 to expand more freely from side to side when it is so heated by the secondary combustion. The top wall of the chamber 15 can be of any convenient shape but preferably it too is arched as shown. The secondary combustion air admission chamber 15 rests on angle iron supports 15*a* and is thus free to expand rearward when it is heated. Preferably, the space between the sides of the chamber 15 and the wall of the combustion chamber is about one quarter of an inch so that the chamber 15 can operate at a higher temperature to promote better secondary combustion.

The furnace 10 is preferably made of welded ¼ inch thick steel plate. Clean out doors and channels, not shown, are preferably located through the rear of the furnace 10 so that if deposits form at the upper and cooler portions of the combustion chamber, such deposits can be removed.

When the secondary combustion air admission chamber 15 has an overall height of ten inches (including six inch legs or skirt), a space between its top and bottom walls of two inches, a length of thirty three inches and a width of twenty three inches and an arch height of two inches and is made of 10 gage steel, then the perforations 16 are preferably 5/32 inch holes in rows, ten rows from side to side and fifteen rows from front to back. The manifolds 17 and 17*a* are preferably 1¼ inch black iron pipe welded to the inside walls of the combustion chamber 11 by way of 1½×2×¼ inch steel tabs 17*b*. The openings 18, 18*a* and 18*b* are preferably made of short lengths of ½ inch black iron pipe (three inches long for the openings 18 and two inches long for the openings 18*a* and 18*b*. Three inch deep by one quarter inch thick fins 25*b*, not all of which are shown, oriented in the direction of the air flow and spaced three inches apart, are preferably welded to the outside of the combustion chamber 11 of the furnace 10 in the upper portions of heat recovery chamber 25 to better recover and store the heat produced. The lower portion of the combustion chamber 11 is preferably lined with firebrick 11*a* retained by angle iron 11*b*. Preferably, thermostat electrical circuits control the blowers 21 and 28 so that the heat output of the furnace 10 is automatically controlled. For example, the blower 21 is preferably controlled to turn on when the bonnet temperature cools to 140 degrees F and to turn off when the bonnet temperature heats to 180 degrees F. The above stated dimensions for the chamber 15, the manifolds 17 and 17*a* and the openings 18, 18*a* and 18*b* provide a good balance between primary and secondary combustion air volumes so that the combustion process is controlled and efficient. If other dimensions are used, then it should be understood that a balance between primary and secondary combustion air volumes should be maintained.

It should be understood that the furnace 10 is a specific example of a furnace according to the instant invention and that many other furnaces could be described as other embodiments of the instant invention. For example, a furnace according to the instant invention could be used to heat water instead of air. Furthermore, a furnace according to the instant invention can, of course, be made larger to heat, for example, factories, greenhouses or grain dryers using waste wood or other relatively inexpensive solid fuels.

The amount of arching of the bottom wall of the secondary combustion air admission chamber is not critical in the instant invention as long as the amount of arching is sufficient to allow the bottom wall to flex as it is heated by the secondary combustion. Preferably, the height of the arch is at least one-quarter inch per foot of chamber width but less than about one foot per foot of chamber width. Most preferably the height of the arch is about one inch per foot of chamber width. The perforations in the bottom wall of the secondary combustion air admission chamber are preferably holes.

What is claimed is:

1. A wood burning furnace, comprising: (a) an enclosed combustion chamber including a top, a bottom, a back, a front and opposing side walls; (b) a secondary combustion air admission chamber including a top, a bottom, a back, a front and opposing side walls, the bottom wall of the secondary combustion air admission chamber being arched and perforated with more than two perforations, the bottom wall of the secondary combustion air admission chamber comprising the top wall of the combustion chamber, the secondary combustion air admission chamber resting on supports attached to the side walls of the combustion chamber so that the secondary combustion air admission chamber is free to expand when heated to a temperature higher than the temperature of the side walls of the combustion chamber.

2. The wood burning furnace of claim 1, further comprising a combustion air blower in fluid communication with the secondary combustion air admission chamber so that combustion air entering the secondary combustion air admission chamber passes through the perforations in the arched bottom wall of the secondary combustion air admission chamber and into the combustion chamber.

3. The wood burning furnace of claim 2, further comprising an air distribution manifold disposed within the combustion chamber, the air distribution manifold having openings disposed to direct air passing therethrough toward the bottom of the combustion chamber, the air distribution manifold being in fluid communication with the combustion air blower.

4. The wood burning furnace of claim 1, wherein the bottom wall of the secondary combustion air admission chamber is arched and perforated with more than ten perforations.

5. The wood burning furnace of claim 2, wherein the bottom wall of the secondary combustion air admission chamber is arched and perforated with more than ten perforations.

6. The wood burning furnace of claim 3, wherein the bottom wall of the secondary combustion air admission chamber is arched and perforated with more than ten perforations.

* * * * *